US007497515B2

(12) United States Patent
Cowan et al.

(10) Patent No.: US 7,497,515 B2
(45) Date of Patent: Mar. 3, 2009

(54) ERGONOMIC CHAIR

(76) Inventors: Benjamin Cowan, Thunder Bay (CA); Jonathan Krehm, legal representative, 29 North Sherbourne St., Toronto (CA) M4W 2T3; Peter Jonathan Joel, legal representative, 27 Prestwick Crescent, North York (CA) M2H 1N1; Michael Cowan, legal representative, 5196 Sonora Drive, North Vancouver (CA) V7R 3V6; Marek Kmicikiewicz, 2100 Chomedey Street Apt. 301, Montreal, QC (CA) H3H 2A9

( * ) Notice: Subject to any disclaimer, the term of this patent is extended or adjusted under 35 U.S.C. 154(b) by 346 days.

(21) Appl. No.: 10/221,186

(22) PCT Filed: Mar. 20, 2001

(86) PCT No.: PCT/CA01/00361

§ 371 (c)(1),
(2), (4) Date: Apr. 20, 2005

(87) PCT Pub. No.: WO01/71527

PCT Pub. Date: Sep. 27, 2001

(65) Prior Publication Data

US 2007/0210634 A1 Sep. 13, 2007

(30) Foreign Application Priority Data

Mar. 23, 2000 (CA) ..... 2302063

(51) Int. Cl.
*A47C 1/024* (2006.01)
*A47C 1/038* (2006.01)
*A47C 3/026* (2006.01)

(52) U.S. Cl. ..... 297/300.3; 297/300.5; 297/301.2; 297/302.2; 297/303.2

(58) Field of Classification Search ..... 297/337, 297/338, 423.12, 423.13, 313, 316, 300.3, 297/300.5, 301.2, 302.2, 302.4, 303.2, 329
See application file for complete search history.

(56) References Cited

U.S. PATENT DOCUMENTS 3,989,297 A * 11/1976 Kerstholt ..... 297/337 X
4,364,605 A * 12/1982 Meiller ..... 297/300.3

(Continued)

FOREIGN PATENT DOCUMENTS

CA 2149898 3/1995

(Continued)

*Primary Examiner*—Rodney B. White
(74) *Attorney, Agent, or Firm*—Ogilvy Renault LLP

(57) ABSTRACT

A work station chair (10) is enabled to shift in response to a person leaning forward in the chair (10) when in a working mode and leaning back in a rest position. The chair includes a seat (18), a backrest (24) and supportive structure. The seat (18) is resiliently supported on the supportive structure (22) and moveably along an arc track (30) which is mounted on the supportive structure and has a radius generated from the ankle of the person sitting on the chair. The backrest (20) is resiliently supported on the seat (18) and moveable along an arc track (64) which is mounted to the seat (18) and has a radius generated from H-point that is a natural pivot point of the torso and thigh lines of the person. The chair (10) provides a combined tilting movement of the person's body about the ankle point and the H-point when the person shifts his or her gravity to reduce adverse static postural loads and forces which are responsible for the fatigue and biomechanical dysfunction. It is also easy to adjust simultaneously the chair and the backrest (20) for different weight loads of persons, which can be done by the person while sitting on the chair (10) and reaching for an adjustment knob (48) in front of the chair.

11 Claims, 7 Drawing Sheets

U.S. PATENT DOCUMENTS 4,383,714 A * 5/1983 Ishida ..... 297/325
4,471,994 A * 9/1984 Zund et al. ..... 297/300.3
4,521,053 A * 6/1985 de Boer ..... 297/313 X
4,537,445 A * 8/1985 Neuhoff ..... 297/300.3
4,603,905 A * 8/1986 Stucki ..... 297/300.3
4,650,249 A * 3/1987 Serber ..... 297/313
4,682,814 A * 7/1987 Hansen ..... 297/300.3
4,684,173 A * 8/1987 Locher ..... 297/300.3
4,709,962 A * 12/1987 Steinmann ..... 297/300.3
4,736,982 A * 4/1988 Hwang ..... 297/423.12 X
4,743,065 A * 5/1988 Meiller et al. ..... 297/300.3
4,747,640 A * 5/1988 Locher ..... 297/300.3
4,765,679 A * 8/1988 Lanuzzi et al. ..... 297/300.3
4,765,684 A * 8/1988 Kvalheim et al. ..... 297/423.13
4,767,160 A * 8/1988 Mengshoel et al. .... 297/423.12
4,787,673 A * 11/1988 Locher ..... 297/300.3
4,793,655 A * 12/1988 Kvalheim et al. ..... 297/423.13
4,818,020 A * 4/1989 Meiller et al. ..... 297/313
4,832,407 A * 5/1989 Serber ..... 297/423.12
4,986,601 A * 1/1991 Inoue ..... 297/300.5 X
5,048,893 A 9/1991 Cowan et al.
5,052,753 A 10/1991 Buchacz
5,054,857 A * 10/1991 Kvalheim ..... 297/423.13
5,186,519 A * 2/1993 Larson ..... 297/423.12
5,253,922 A * 10/1993 Corlett ..... 297/337 X
5,255,957 A * 10/1993 Opsvik et al. ..... 297/423.12
5,261,727 A * 11/1993 Klaebel ..... 297/423.13
5,447,358 A * 9/1995 Corlett ..... 297/337 X
5,536,067 A * 7/1996 Pinto ..... 297/423.13 X
5,542,746 A * 8/1996 Bujaryn ..... 297/423.12
5,577,802 A 11/1996 Cowan et al.
5,667,278 A * 9/1997 Li ..... 297/423.13
5,782,534 A * 7/1998 Desanta ..... 297/423.13
6,224,154 B1 * 5/2001 Stoki ..... 297/338 X
6,431,649 B1 * 8/2002 Hensel ..... 297/316 X

FOREIGN PATENT DOCUMENTS

CH 659179 A5 * 1/1987 ..... 297/300.5
CH 675194 A5 * 9/1990 ..... 297/338
DE 3541120 A1 * 5/1987 ..... 297/423.12
EP 69410 A1 * 1/1983 ..... 297/300.3
EP 252274 A2 * 1/1988 ..... 297/423.13
EP 0 742 689 11/1996
GB 2176396 A * 12/1986 ..... 297/423.12
WO WO 9309701 A1 * 5/1993 ..... 297/423.13
WO WO 9401050 A1 * 1/1994 ..... 297/313

* cited by examiner

ERGONOMIC CHAIR

TECHNICAL FIELD

The present invention relates to a sitting unit such as a chair and, more particularly, to a work station chair which can shift in response to different positions of a person sitting on the chair, leaning forward in work mode and leaning back in a rest position.

BACKGROUND ART

The demands of the seated work position mandate the user to accommodate a range of postural adjustments from the slightly rearward reclined rest position through to the forward hunched task posture. Passive automatic adaptation or adjustment of the seat support system is required if the natural balance and equilibrium of the body's support is to be maintained. Failure to maintain the body's equilibrium and structural balance will result in the creation of adverse, static postural loads and forces responsible for fatigue and biomechanical dysfunction so common in today's seated society.

There have been many attempts to better design a seating arrangement for persons working at a desk or computer terminal. Such ergonomic chairs are described, for instance, in U.S. Pat. No. 4,650,249 which issued on Mar. 17, 1987 to Cerber; U.S. Pat. No. 4,738,487 which issued on Apr. 19, 1988 to Shalinsky et al.; U.S. Pat. No. 5,048,893 which issued on Sep. 17, 1991 to Cowan et al. and Applicant's Canadian patent application Ser. No. 2,116,079 which was filed on Feb. 21, 1994 and laid-open on Aug. 23, 1994 in the inventors' names of Cowan et al. It has been found that when a person leans forward to work or back in a rest position, there is a movement combination of the person's body pivoting about the ankles of the person with the person's upper body pivoting about a center called the "H-point" which is a natural pivoting point of the torso and thigh lines. The H-point is defined in SAE standard J826. Although most chairs described in the above prior art provide reasonable adjustment in the fore and aft directions and allow for tilting of the seat, they do not provide, except in Canadian patent application Ser. No. 2,116,079, the combined movement of seats and backrests pivoting about the respective ankle point and the H-point and, therefore, result in a compromise in terms of vertical adjustment. An upward movement of any part of the chair will jeopardize the body's equilibrium and structural balance.

Cowan et al. describes, in Canadian patent application Ser. No. 2,116,079, a work station chair having a seat passively pivotable about the ankle of the person sitting on the chair and a backrest passively pivotable about the H-point. A cable system is provided for positive adjustment of resiliency of the pivoting movement of the seat and backrest for different weight loads of persons sitting on the chair. However, the H-point is physically required in the chair, which is a pair of pivoting pins attached to two arm support posts respectively. Such a configuration limits the application of the H-point backrest because the position of the H-point is always above the seat and cannot be attached to the supportive structure under the seat. Therefore, an improvement is desirable. A positive adjustment mechanism simpler in structure and easier for use is also desired to replace the cable system which has to be adjusted in an inconvenient rear position.

DISCLOSURE OF THE INVENTION

It is an object of the present invention to provide an improved work chair of the type described above but without the disadvantages mentioned hereinabove.

It is another object of the present invention to allow the user to passively maintain the natural lordotic curvatures and integrated biomechanical relationship of the spine, pelvis and lower limbs in a balanced dynamic equilibrium while in the seated posture either for work or in rest.

It is a further object of the present invention to provide a chair which provides a passive adjustment combination of a seat thereof pivoting about an ankle point of the user with a backrest pivoting about a natural pivot point of the torso and thigh lines of the user in response to a shift in gravity of the user sitting on the chair, the respective pivot points being virtually required in the chair structure.

It is yet a further object of the present invention to provide a positive adjustment mechanism which is simple in structure and easy for use to adjust the resiliency of the seat and backrest in their passive adjustment.

In a general term, the present invention is used to provide a chair passively adjustable in response to the shift center of gravity of a person sitting on the chair, comprising a supportive structure adapted to support the chair and the weight of the person; a seat adjustably mounted on the supportive structure and pivotable in a vertical plane about an ankle point of the person; a backrest adjustably mounted on the seat and pivotable in the vertical plane about a nature pivot point of the torso and thigh lines of the person; resilient means for resiliently supporting the respective seat and backrest in a position in which the person sitting erectly or forwardly for work, and permitting the seat and backrest to pivot in response to the shift center of gravity of the person for rest; and a positive adjustment mechanism mounted on a front of the chair and associated with the resilient means for positively adjusting the resilience of the resilient means by the person while sitting on the chair.

The resilient means preferably comprises a first support end pivotly mounted on the supportive structure, a second support end pivotally mounted on the backrest, and a third support end pivotally mounted to the positive adjustment mechanism and slidable relative to the seat for adjusting the resilience of the resilient means.

In accordance with one aspect of the invention, a backrest structure for a chair comprising a curved track in fixed relation to a seat of the chair; a carriage slidably mounted on the curved track; a backrest mounted on the carriage; a resilient support mechanism provided for resiliently supporting the carriage and backrest with respect to the seat so that the carriage is biased uppermost to support the backrest in an erect position, and adapted to slide down along the curved track and tilt the backrest rearwards and downwardly in response to a rearward shift of the weight of a person sitting on the chair and leaning against the backrest.

The curved track is preferably a circular arc having a radius in a vertical plane generated from a point which substantially matches a natural pivot point of the torso and thigh lines of the person sitting on the chair so-called H point.

In a more specific embodiment of the present invention, the chair further includes: a supportive structure adapted to support the chair and the weight of a person sitting on the chair, a curved track mounted on the supportive structure, a carriage slidably mounted on the curved track and attached in a fixed relationship to a base of the seat so that the base is moveable relative to the supportive structure, and a resilient support mechanism is provided for resiliently supporting the base relative to the supportive structure so that the carriage is biased to support the seat on the base in a substantially horizontal position and is enabled to slide down along the curved track and tilt the seat rearwards and downwardly in response to a rearward shift of the weight of the person sitting on the chair. The curved track is a circular arc having a radius in a vertical plane generated from a point which is close to a natural pivot point of the ankle joint of the person.

The chair structure according to the present invention is simple and applicable to different styles of work station chairs, such as chairs with or without arm support. The chairs are comfortable and reduce adverse static postural loads and forces, especially in reclined position when angle between torso and thigh is open which are responsible for the fatigue and biomechanical dysfunction. It is easy to adjust the chairs for different weight loads of persons, which can be done by the person while sitting on the chair and reaching for an adjustment knob in front of the chair and under the seat pan.

Other features and advantages of the invention will be apparent from the description of a preferred embodiment given hereinafter.

BRIEF DESCRIPTION OF THE DRAWINGS

Having thus generally described the nature of the invention, reference will now be made to the preferred embodiment thereof and the accompanying drawings, in which.

MODE FOR CARRYING OUT THE INVENTION

Figure 1:
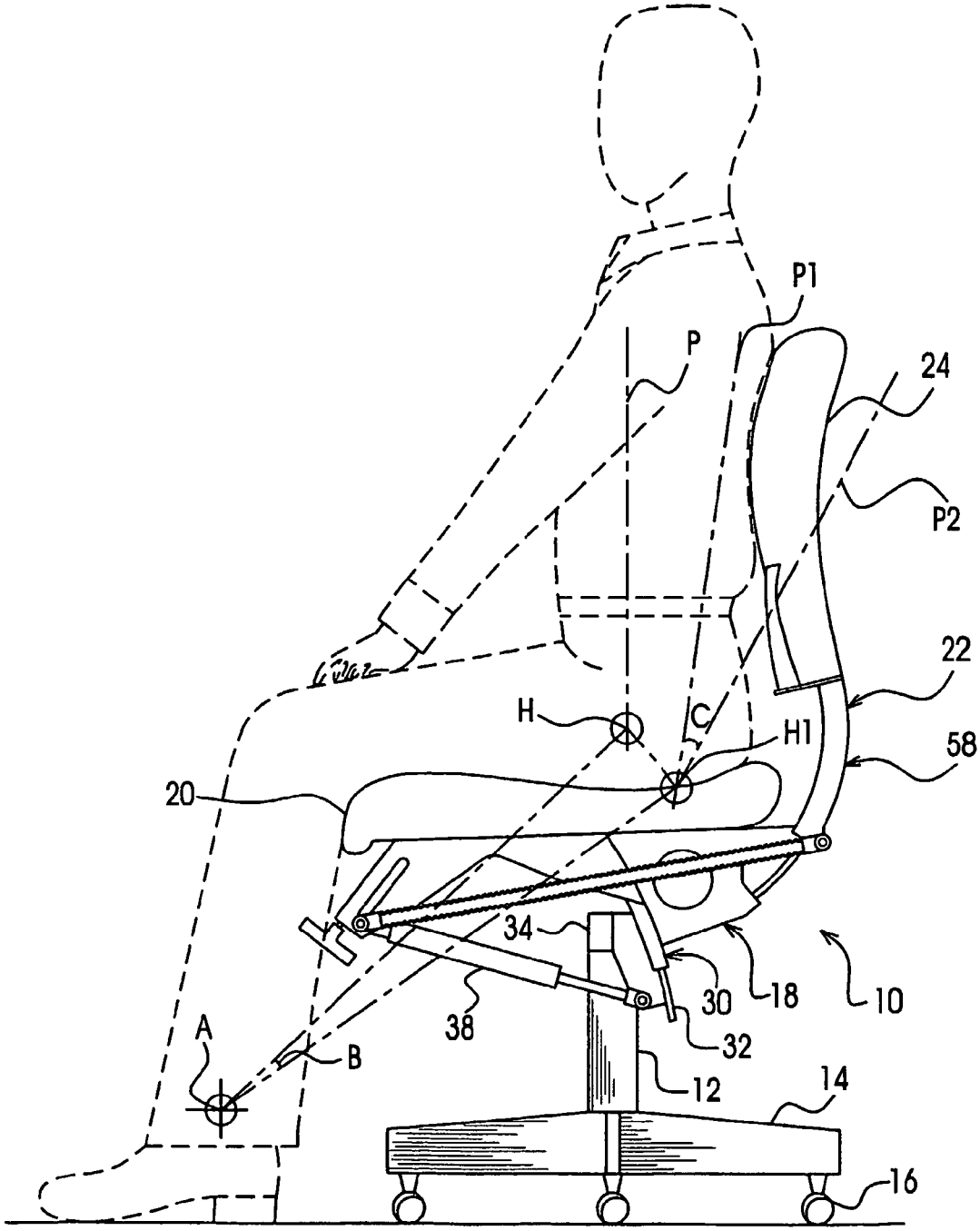
FIG. 1 is a side view of a chair in accordance with the preferred embodiment of the invention.

Referring now to the drawings and, in particular, to FIG. 1, there is shown a chair 10 having an upstanding post 12 and a base 14 mounted with rollers 16, as seen in typical work station chairs. The chair 10 also includes a seat portion 18 having a seat 20 that is fixed on carriage 30 to support the weight of the person sitting on the chair, and a backrest portion 22 having a backrest 24 that is mounted to the seat portion 18 for supporting the upper body of the person. The seat portion 18 is rotatable in a horizontal plane about an axis of the post 12 and pivotable in a vertical plane about an ankle point A of the person while the backrest portion 22 is pivotable in the vertical plane about a natural pivot point H is at the intersection of the torso and thigh lines of the person. Having thus structured, the chair 10 is enabled to move and be oriented in any direction as well as provide passive adjustment in response to shift in the weight of the person between a position in which the person sits erectly or leans forward for work and another position in which the person tilts and leans rearwardly in rest. The activation of the mechanism is a result of the combination of the body of the person pivoting about the ankle point A with the upper body of the person pivoting about the H point.

Figure 2:
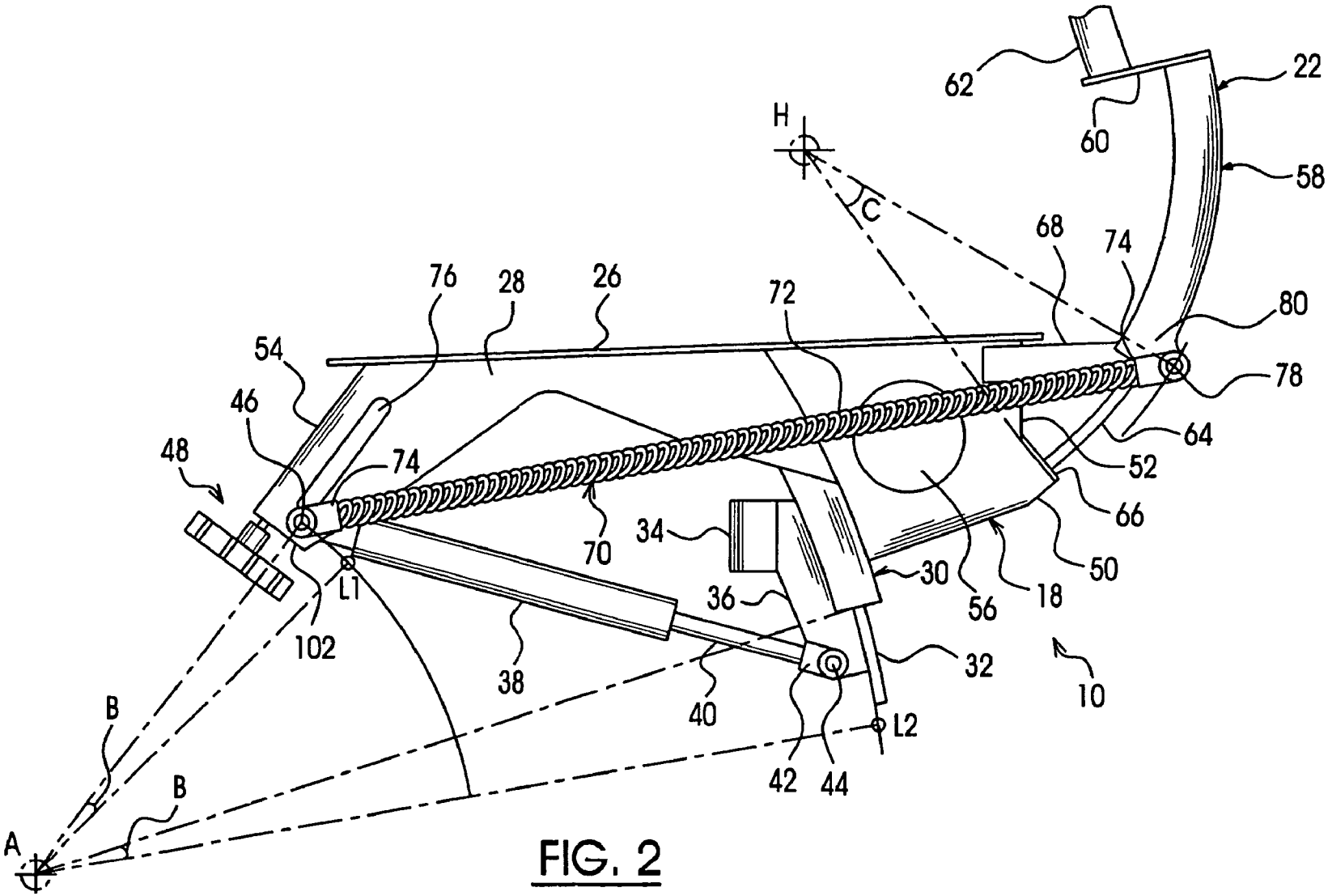
FIG. 2 is a partial side view of a frame structure of the chair in FIG. 1.
Figure 3:
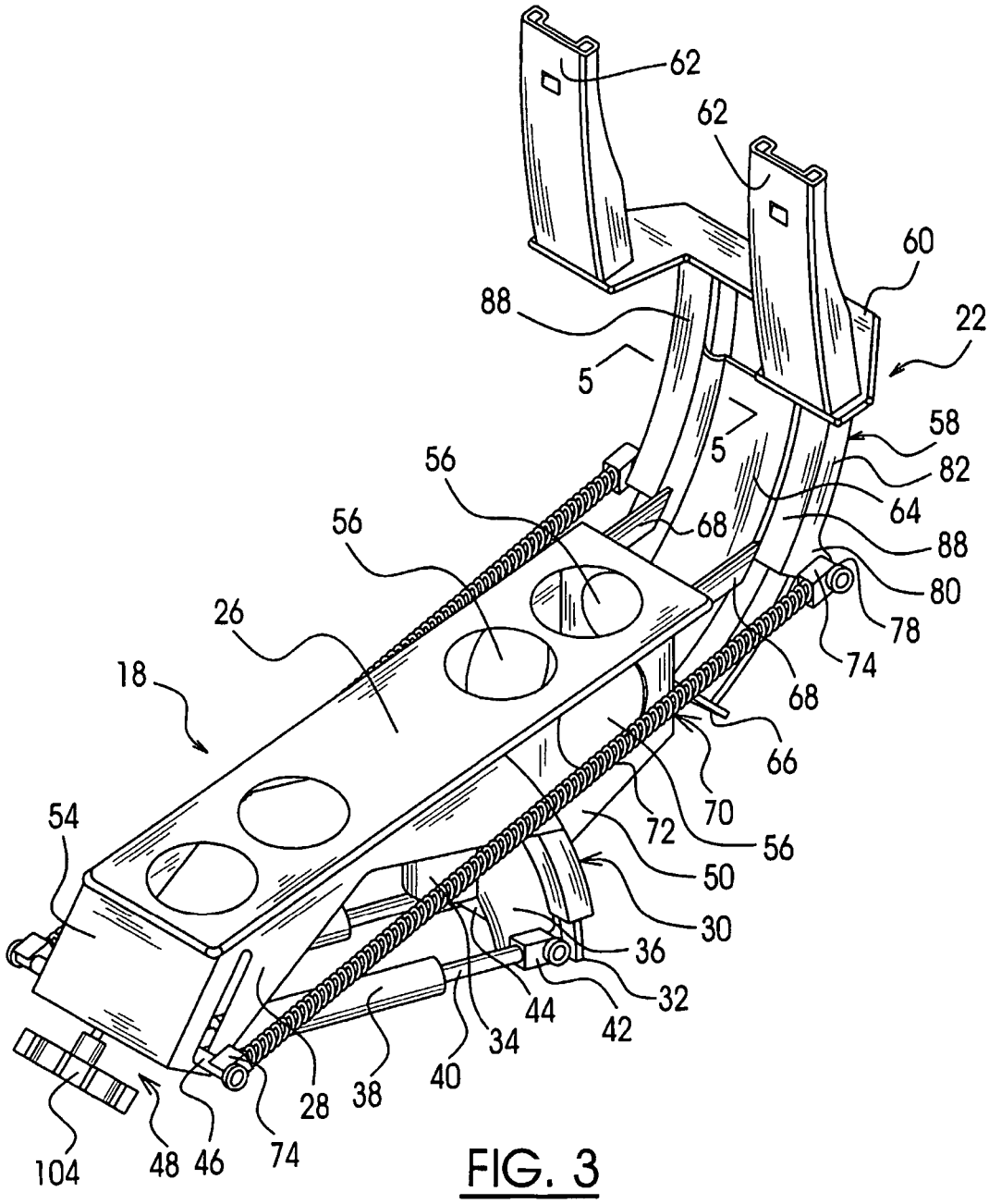
FIG. 3 is a top end front perspective view of the frame structure in FIG. 2.

The structural details of the chair 10 is now described with reference to FIGS. 2 and 3 in which a frame structure of the chair 10 is shown. The seat portion 18 further includes a seat plate 26 which is rectangular, and two side plates 28 extend downwards from two sides of the seat plate 26, respectively. A carriage 30 is fixed to the undersurface of the seat plate 26 and to the rear ends of the two side plates 28, and rolls on a track member 32. The track member 32 is mounted to the sleeve 34 by side plates 36. The track member 32 is a circular arc track having a predetermined radius, and is welded or otherwise fixed to the mounting sleeve 34 through a pair of sleeve side plates 36 in such a position that the central point of the circular arc track 32 is close to the ankle point A of the person sitting on the chair after the chair installation is completed.

The sleeve 34 is mounted to the rotatable cylinder of the post 12. The sleeve 34 and the post 12 assembly may include bearings and height adjustment structures which are not shown, but are typical in the existing work station chairs in the market, and are well known by those skilled in the art.

A similar carriage and track assembly is used for the backrest of the chair and, therefore, the structural details of the carriage and the track assembly will be described below when the backrest structure is described. The seat portion 18 is resiliently supported by two compressible gas cylinders 38. Each gas cylinder 38 includes a piston rod 40 axially extending from the cylinder 38, terminating at a piston rod end 42. A rear cylinder support rod 44 is supported on the lower end of the sleeve side plates 36, extending transversely with two ends protruding outwardly from the respective sleeve side plates 36. The rear cylinder support rod 44 is perpendicular to the piston rods 40 and each end of the rear cylinder support rod 44 is rotatably received in a concave surface on the piston rod end 42 at either side of the seat portion 18. A cylinder end, not shown, has a similar concave surface to rotatably receive a front cylinder support rod 46 which is parallel to the rear cylinder support rod 44, and adjustably supported by a positive adjustment assembly 48 mounted on the front end of the seat portion 18. Having this arrangement, the seat portion 18 and the weight load of the person sitting on the seat are supported by the post 12 through the gas cylinders 38 when the carriage 30 under the load rolls down along the track member 32 and the gas cylinder 38 is compressed to a certain extent. The resilient force caused by the compressed gas cylinders 38 balances the load. This will be a normal position for a person sitting on the chair in an erect position, as shown in FIG. 1.

It is noted that the front cylinder support rod 46 is supported on the seat portion 18 and the position thereof relative to the seat portion is not changed in the passive adjustment when the gas cylinder 38 is compressed by the weight load. However, the front cylinder support rod 46 is enabled to be changed in positions relative to the seat portion 18 for different weight loads of persons utilizing the chair when the positive adjustment assembly 48 is adjusted. The detail of the positive adjustment assembly 48 and its operation will be described hereinafter.

The seat portion 18 further includes a pair of support side plates 50 and a rear end plate 52. The support side plates 50 are welded or otherwise connected to the rear side of the carriage 30 and the undersurface of the seat plate 26, and interconnected by the rear end plate 52 at the rear ends to form a rigid frame structure of the seat portion 18, providing a base for attachment of the backrest portion 22. A front plate 54 having an L-shape in cross-section is attached to the front end of the seat plate 26 and between two side plates 28 to provide a structural support for the attachment of the positive adjustment assembly 48. A plurality of apertures 56 are defined in the respective seat plate 26, support side plates 50 and the rear end plate 52 to reduce the weight of the frame structure.

Mounting bores, not shown, are provided in the seat plate 26 for mounting the seat 20.

The backrest portion 22 includes a carriage 58 which is attached to an adapter plate 60. The adapter plate 60 in turn supports a pair of mounting brackets 62 of a fork type which are well known and adapted to support the backrest 24. Any other arrangement can be used to attach the backrest 24.

The carriage 58 rolls on a track member 64 which has a circular arc in the vertical plan and terminates at an end plate 66 to stop the downward movement of the carriage 58 relative to the track member 64 at the lowest extremity. The track member 64 is supported on the two support side plates 50 by the end plate 66 and a pair of attachment strips 68. The circular arc of the track member 64 has a predetermined radius and the track member 64 is attached to the seat portion 18 of the chair in such a position that the radius center of the circular arc of the track member 64 substantially matches the natural pivot point H of the torso and thigh lines of the person sitting on the chair after the installation of the chair is completed, as shown in FIG. 1.

The backrest portion 22 is resiliently supported by a pair of compressible spring rods 70 positioned at the respective sides. Each spring rod 70 is provided with a telescoping rod (not shown) extending through a spiral spring 72 which is pre-compressed between the two ends 74 of the spring rod. The telescoping rod inside the spiral spring 72 permits the spring rod 70 to be compressible and prevents the spiral spring 72 from losing stability and buckle. The front end 74 of the spring rod 70 is provided with a concave surface for rotatably receiving the front cylinder support rod 46 which has its two respective ends protruding outwardly from a pair of slots 76 defined in the respective side plates 28. Similarly, the rear end 74 of the spring rods 70 has a concave surface for rotatably receiving a spring rod support pin 78 which extends perpendicularly to the spring rods 70 and is supported by a pair of brackets 80 at the respective sides of the carriage 58 such that when the person sitting on the chair leans backwards and downwardly, the backrest 24 pivots about the H-point (shown in FIG. 1) and the whole backrest portion 22 slides along the track member 64, compressing the spring 70 until the spring force balances a component of the weight load of the person supported by the backrest 24.

Figure 4B:
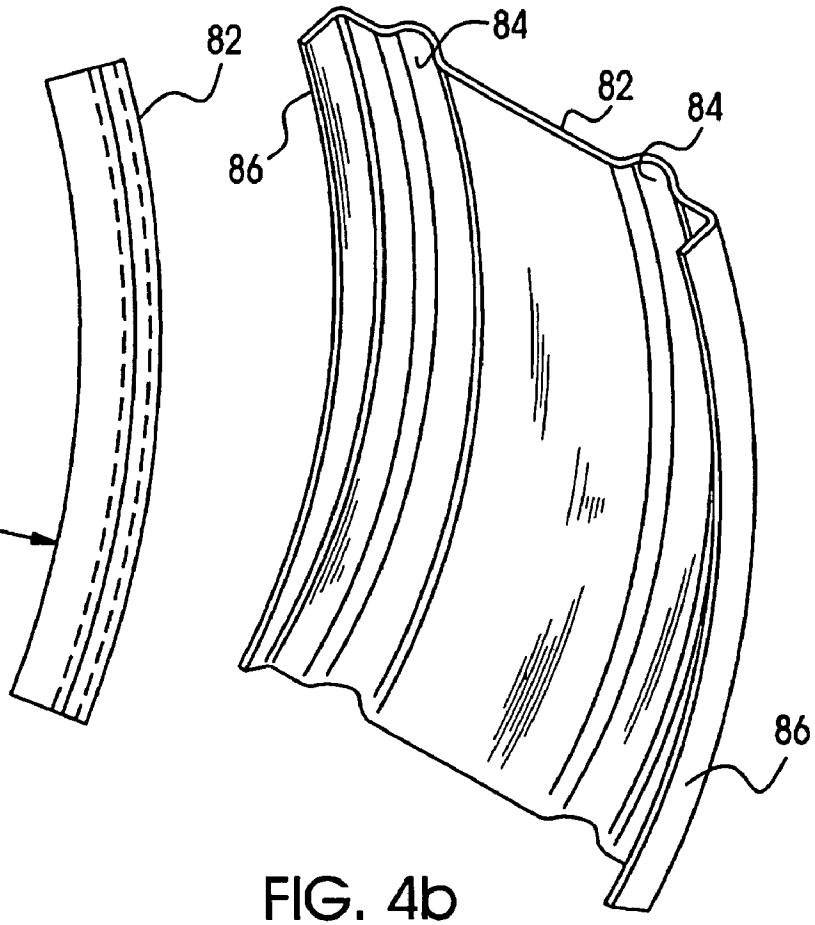
FIG. 4*b* is a perspective view of the backrest moving rail in FIG. 4*a*, showing the grooves for bearing balls.
Figure 4A:
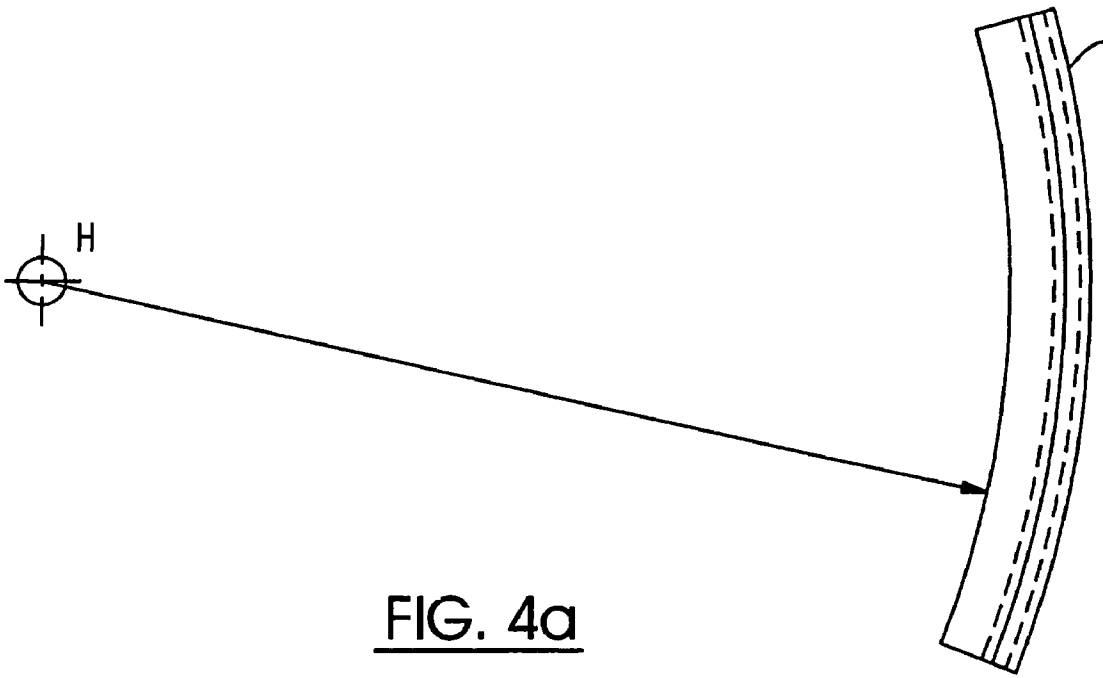
FIG. 4*a* is a side view of a backrest moving rail.
Figure 6:
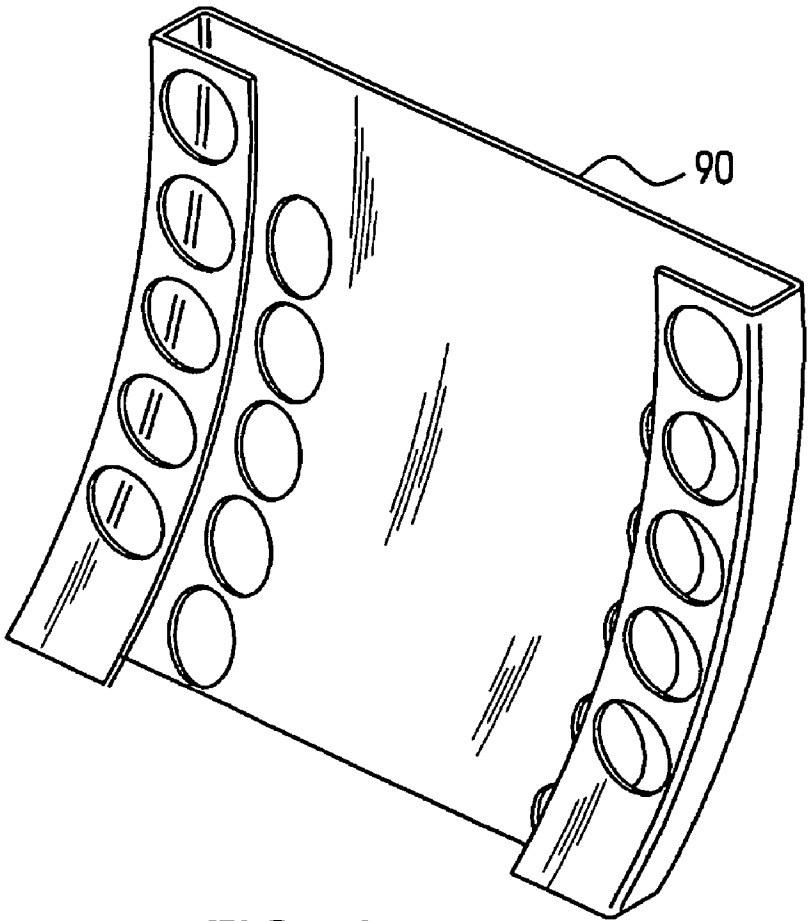
FIG. 6 is a perspective view of the backrest balls cage.
Figure 5:
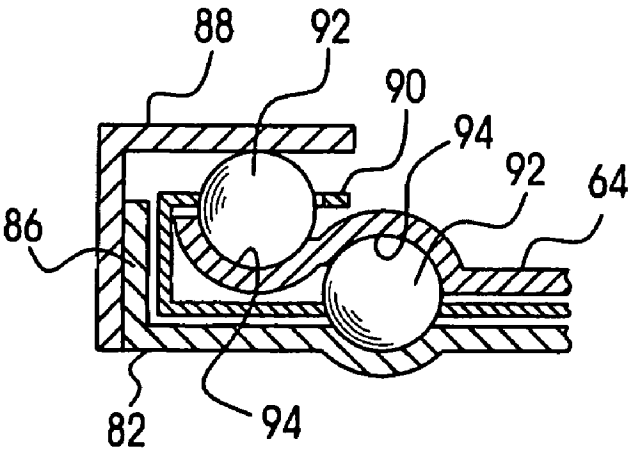
FIG. 5 is a partial cross-sectional view of the backrest rail assembly taken from lines 5-5 in FIG. 3.

The carriage and track member assemblies for passively adjustable support of the seat or backrest can be configured in various structures, such as described in the Applicant's Canadian Patent Application No. 2,116,079. Another example is described in FIGS. 4*a*, 4*b*, 5 and 6 according to the preferred embodiment of the invention. These drawings only show the details of the carriage 58 and track members 64 of the backrest portion 22 in order to avoid redundancy. However, the structural features are similarly applied to the carriage 30 and track member 32 assembly of the seat portion 18, except different radii of curvature are required to meet the different requirements of the pivoting points A and H. In FIGS. 4*a* and 4*b*, a main moving rail 82 is a steel plate formed generally in a circular arc having a radius of curvature generated from the H point when it is installed to the chair. The main moving rail 82 includes two grooves 84 at two sides acting as bearing ball races. The two sides of the steel plate of the main moving rail 82 are bent to form two side flanges 86 to weld a claw rail 88 (see FIGS. 3 and 5) at each side. A plastic ball cage 90 is provided to hold two rows of bearing balls at each side in position within the carriage 58. A perspective view of the ball cage 90 is shown in FIG. 6. The cage 90 has a radius of curvature similar to the main moving rail 82, and is restrained within the carriage 58 by any means well known to the person skilled in the art. The two rows of bearing balls roll on two respective ball races defined by two respective grooves 94 on each side of the track member 64.

Figure 7:
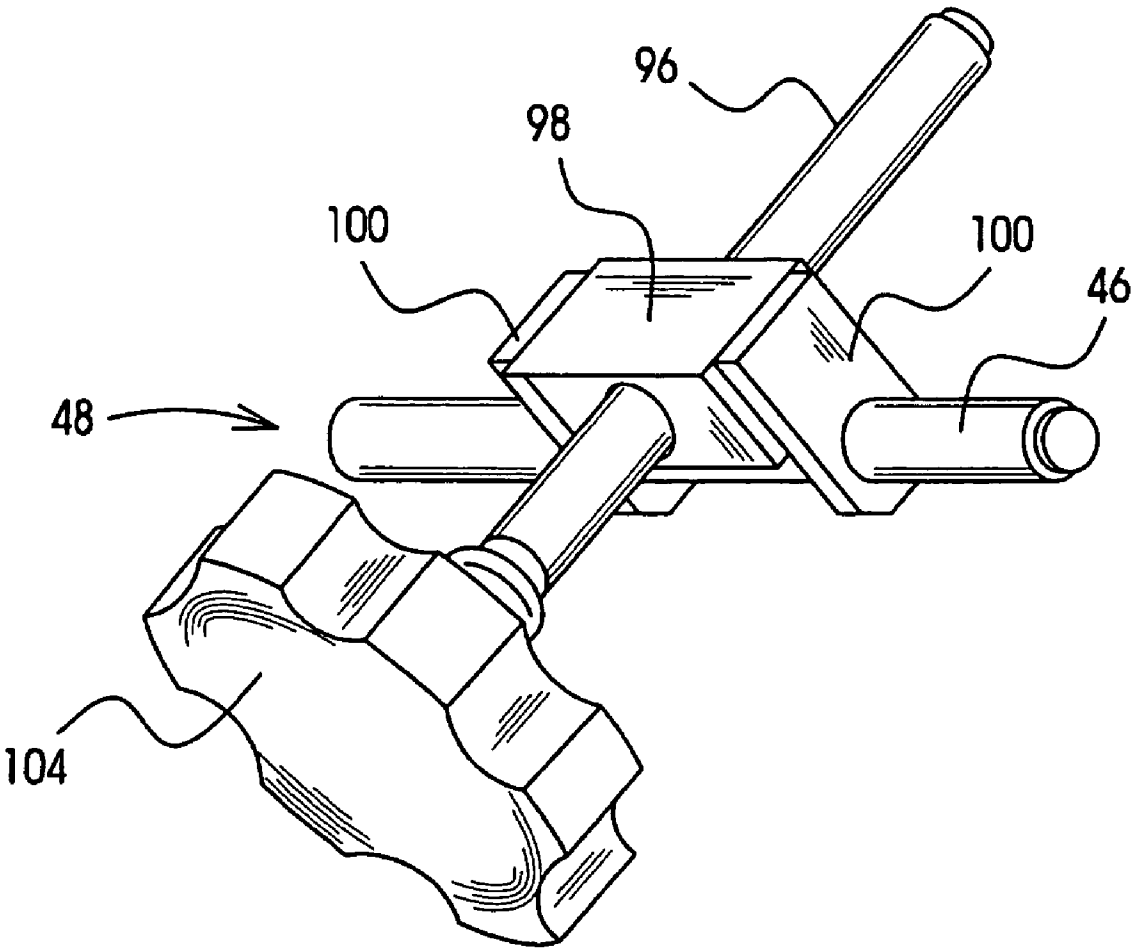
FIG. 7 is a perspective view of a positive adjustment assembly for adjusting the resilience of the seat and the backrest of the chair.

FIG. 7 illustrates the positive adjustment assembly 48 which includes a threaded bolt 96 (the threads not shown) that are threadedly connected to an adjustment bar 98. Two adjustment bar side plates 100 are welded, or otherwise attached to the two sides of the adjustment bar 98, and each adjustment bar side plate 100 has an aperture for snugly receiving the front cylinder support rod 46. The threaded bolt 96 is rotatably supported at one end by a bracket, not shown, which is fixed to the top on the inner side of the front plate 54 and at the other end is rotatably supported by the shorter portion 102 of the L-shaped front plate 54 (see FIG. 2) so that the bolt 96 is rotatable but prevented from axial movement relative to the front plate 54. The front cylinder support rod 46 is slidably received by the two slots 76 which are parallel to the threaded bolt 96 and defined in the side plates-28 to prevent the adjustment bar 98 from rotation with the bolt 96 so that the front cylinder support rod 46 is moved forward or backward along the slots 76 when the bolt 96 is rotated. A knob 104 is mounted to a head portion (not shown) of the threaded bolt 96 which extends outwardly from the shorter section 102 of the L-shaped front plate 54 for the person to conveniently make simultaneous adjustment of the chair and the backrest resiliency while still sitting on the chair.

Figure 8:
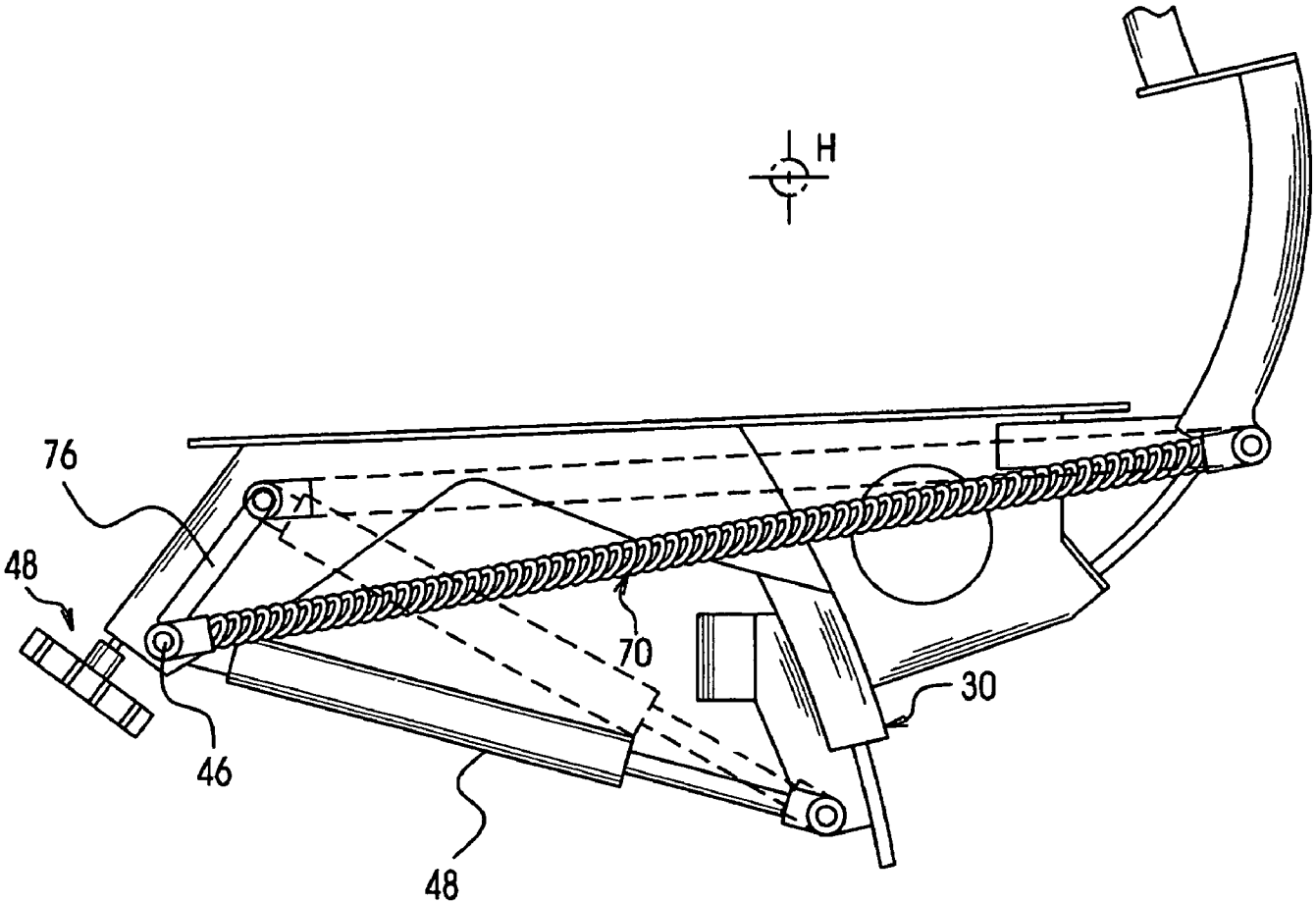
FIG. 8 is a partial side view of the frame structure in FIG. 2, showing the positive adjustment in response to the different weight loads of persons utilizing the chair.

In operation, the person using the chair assumes a working position as shown in FIG. 1. In this position, the person is upright or leaning forward over a work table. In such a case, the center of gravity of the person is over the post 12 or forward thereof. The gas cylinders 38 should be sufficient to maintain the seat 20 in a substantially horizontal position and thus the carriage 30 is in its upper position such as shown in FIGS. 1, 2 and 8. The weight of the person using the chair will effect the equilibrium of the carriage 30 on the track member 32. In this position, the chair functions as normal work station chair and the backrest 24 receives no or little component of the weight load. The carriage 58 is also in its upmost position.

When the person leans back in a rest position, the center of gravity shifts rearwardly relative to the point A to a point where the action moment overcomes the resiliency moment of the gas cylinders 38 to move the front cylinder support rod 46 to the point L1 (see FIG. 2), for example. The lower end of the carriage 30 begins to move downwardly following the arcuate path of the track member 32 to the point L2 so that the seat portion 18 tilts backwards and downwardly in an angle B about the ankle point A. Meanwhile, a component of the weight load of the person acts on the backrest 24 to an extent in which the action moment overcomes the resilience of the spring 70 to move the spring rod support pin 78 downwardly and forwardly along the track member 64 until the carriage 58 is stopped by the track and plate 66, as an extreme example. The backrest 24 tilts backwardly and downwardly together with the backrest portion 22 over an angle C about the H point.

The combination of the tilting movement of the seat 20 with the tilting movement of the backrest 24 is illustrated in FIG. 1. A vertical line P passing through the H point represents an erect position of the person sitting on the chair. When the person leans back to a rest position as described above, the seat 20 with the whole seat portion 18 tilts over the angle B about the ankle point A so that the body of the person pivots down over the angle B about the ankle point A and therefore the natural pivot point H of the torso and thigh lines of the person moves to H1 and the line P moved to P1, no longer being vertical. Because of the tilting movement of the backrest 24 with the whole backrest portion 22, the line P1 further pivots rearwardly and downwardly over the angle C about the pivoting point H1 to a position shown as P2 which represents the position of the upper body of the person in the rest position with the open angle of the torso and thighs. In the combination of the two tilting movements of the chair, there are no parts of the chair having an upwardly moving component which usually exists with most chairs in the prior art and causes the person utilizing the chair to be in an unnatural and uncomfortable position when the feet lose contact with the floor and pressure is applied to the underside of the thighs.

FIG. 8 illustrates the function of the positive adjustment assembly 48 used in this embodiment. The position for lighter persons is shown in FIG. 8 in full lines. When a heavier person is to use the chair, the knob 104 is rotated so as to move the front cylinder support rod 46 along the slots 76 toward the extreme position shown in broken lines or intermediate positions therebetween. Both spring rods 70 and the gas cylinders 38 are further compressed relative to their positions shown in full lines. Being thus pre-compressed, the spring rods 70 and gas cylinders 38 are harder and will balance a more heavier weight load of a person in a normal work position. Because of the orientation of the slots, the gas cylinders 38 are not compressed as much as the spring rod 70 when they are adjusted to the position shown in broken lines. However, the gas cylinders 38 in the position shown in broken lines are further away from the ankle point A, thereby increasing the resistance to downward movement of the carriage 30 because a spring force will produce a bigger moment of force about point A to balance the action moment produced by a heavier weight load of a person utilizing the chair when the acting point of the same spring force is moved further away from the pivoting point A.

Modifications and improvements to the above-described embodiment of the invention may become to those scaled in the art. The foregoing description is intended to be exemplary rather than limiting. The scope of the invention is therefore intended to be limited solely by the scope of the appended claims.

The invention claimed is:

1. A backrest structure for a chair having:

a curved track in a fixed relation to a seat of the chair;

a carriage slidably mounted on the curved track;

a backrest mounted on the carriage;

a resilient support mechanism provided for resiliently supporting the carriage and backrest with respect to the seat so that the carriage is biased uppermost to support the backrest in an erect position, and adapted to slide down along the curved track and tilt the backrest rearwards and downwardly in response to a rearward shift of the weight of a person sitting on the chair and leaning against the backrest, the resilient support mechanism including a pair of compressible spring rods positioned at sides of the chair;

adjustment means provided for adjusting the resilient support mechanism such that the backrest is enabled to be maintained in the erect position in response to different body loads of persons utilizing the chair, wherein the resilient support mechanism is anchored at a first end to the carriage and at a second end to the adjustment means.

2. A backrest structure as claimed in claim 1 wherein the adjustment means comprise a threaded bolt rotatably mounted on a front end of the seat, an adjustment bar threadedly connected to the threaded bolt and associated with the second end of the spring rod so that the spring rod is pre-compressed when the threaded bolt is rotated.

3. A backrest structure as claimed in claim 2 wherein ball bearings are provided between the carriage and the curved track.

4. A chair comprising:

a seat and a base of the chair for supporting the seat;

a supportive structure adapted to support the chair and the weight of a person sitting on the chair;

a first curved track mounted on the supportive structure;

a first carriage movably mounted on the first curved track and attached in fixed relation to the base so that the base is movjable relative to the supportive structure;

a first resilient support mechanism provided for resiliently supporting the base relative to the supportive structure, the first carriage being biased to support the seat in a substantially horizontal position;

a backrest of the chair;

a second curved track mounted to the base;

a second carriage movably mounted on the second curved track, and associated in fixed relation with the backrest so that the backrest is moveable relative to the base a second resilient support mechanism provided for resiliently supporting the second carriage and backrest with respect to the base, the second carriage being biased uppermost to support the backrest in an erect position; and an adjustment mechanism provided for simultaneously adjusting the resilience of the first and second resilient support mechanisms in response to different weight loads of persons utilising the chair, wherein the first resilient support mechanism is anchored at a first end to the supportive structure and at a second end to the adjustment mechanism mounted on the base; and whereby the first and second carriages &re enabled to slide down along the respective first and second curved tracks and tilt the respective seat and backrest rearwards and downwardly in response to a rearward shift of the weight of a person sitting on the chair and leaning against the backrest.

5. A chair as claimed in claim 4 wherein the first resilient support mechanism includes a pair of compressible gas cylinder assemblies having one end anchored to the adjustment mechanism.

6. A chair as claimed in claim 5 wherein the second resilient support mechanism includes a pair of compressible spring rods, each being anchored at a first end to the second carriage and a second end to the adjustment mechanism.

7. A chair as claimed in claim 6 wherein the adjustment mechanism comprises a threaded bolt rotatably mounted to the base and an adjustment bar threadedly connected to the threaded bolt and associated with the end of the gas cylinder assemblies and the second end of the spring rods, so that the gas cylinder assemblies and spring rods are pre-compressible when the threaded bolt is rotated.

8. A chair as claimed in claim 7 wherein the base includes a seat plate on top of which the seat is attached, two side plates extending downwards from two sides of the seat plate respectively, and a slot being defined in each side plate at a front end, the slots receiving a cylinder support rod which is laterally extending therethrough and slidable along the slot, the cylinder support rot being attached to the adjustment bar and connected to the end of the gas cylinder assemblies and the second end of the spring rods so that the end of the cylinder assemblies and the second end of the spring rods are moveable along the slot in response to the rotation of the threaded bolt.

9. A chair as claimed in claim 8 wherein the supportive structure includes a vertical stem rotatably received in a sleeve mounted to the first curved track.

10. A chair as claimed in claim 9 wherein ball bearings are provided between the first carriage and the first curved track, and between the second carriage and the second curved track.

11. A chair as claimed in claim 4, wherein the adjustment means are mounted on a front end of the base.

* * * * *